US006595682B2

(12) United States Patent
Mathys et al.

(10) Patent No.: US 6,595,682 B2
(45) Date of Patent: Jul. 22, 2003

(54) MIXING ELEMENT FOR A FLANGE TRANSITION IN A PIPELINE

(75) Inventors: Peter Mathys, Neuhausen (CH); Stefan Frohofer, Russikon (CH)

(73) Assignee: Sulzer Chemtech AG, Winterthur (CH)

( * ) Notice: Subject to any disclaimer, the term of this patent is extended or adjusted under 35 U.S.C. 154(b) by 15 days.

(21) Appl. No.: 09/846,493

(22) Filed: Apr. 30, 2001

(65) Prior Publication Data

US 2001/0038575 A1 Nov. 8, 2001

(30) Foreign Application Priority Data

May 8, 2000 (EP) ..... 00810390

(51) Int. Cl.[7] ..... B01F 5/06
(52) U.S. Cl. ..... 366/337; 366/181.5; 138/40
(58) Field of Search ..... 366/181.5, 337, 366/336; 138/40

(56) References Cited

U.S. PATENT DOCUMENTS 1,199,243 A * 9/1916 Bushey
1,569,519 A * 1/1926 Middaugh
1,610,507 A 12/1926 Foley
3,090,603 A 5/1963 Johnson
4,019,719 A 4/1977 Schuster
4,212,544 A * 7/1980 Crosby ..... 366/136
4,220,416 A * 9/1980 Brauner et al. ..... 366/337
4,313,680 A * 2/1982 Honnen ..... 366/337
4,758,098 A 7/1988 Meyer
5,492,408 A * 2/1996 Alfare ..... 366/337
5,522,661 A 6/1996 Tsukada
5,839,828 A 11/1998 Glanville
5,967,658 A * 10/1999 Mohajer ..... 366/337
6,109,781 A * 8/2000 Ogasawara et al. ..... 366/336
6,394,644 B1 * 5/2002 Streiff ..... 366/337

FOREIGN PATENT DOCUMENTS

EP 0063729 A2 11/1982

* cited by examiner

*Primary Examiner*—Tony G. Soohoo
(74) *Attorney, Agent, or Firm*—William Michael Hynes; Townsend and Townsend and Crew LLP

(57) ABSTRACT

The mixing element (2) is provided for a flange transition (10) in a pipeline (1) and can be mounted between two flanges (11, 12) of the pipeline. It comprises a mixing-active structure (25) which is formed by one or two vanes (**25*a*, 25*b*) within a ring (20). Two mutually inclined planes (21, 22) can be defined, with the one vane being arranged on the one plane or the two vanes being arranged on the two planes. The two planes intersect at a crossing axis (23). Closed sub-surfaces (52, 51') as well as open pieces of surface (51, 520, 521, 522) of vanes form a surface pattern (5) which is formed asymmetrically with respect to the crossing axis. Through the asymmetric shape a fluid (9) which flows through the pipeline can be deflected in such a manner that partial flows (9*b*) are deflected from one pipe half through sub-surfaces of the one plane (21) into the other pipe half and encounter there largely non-deflected partial flows, with this also holding vice versa with respect to the other plane (22) if on the latter there is a second vane (25*b***) having structure elements.

12 Claims, 5 Drawing Sheets

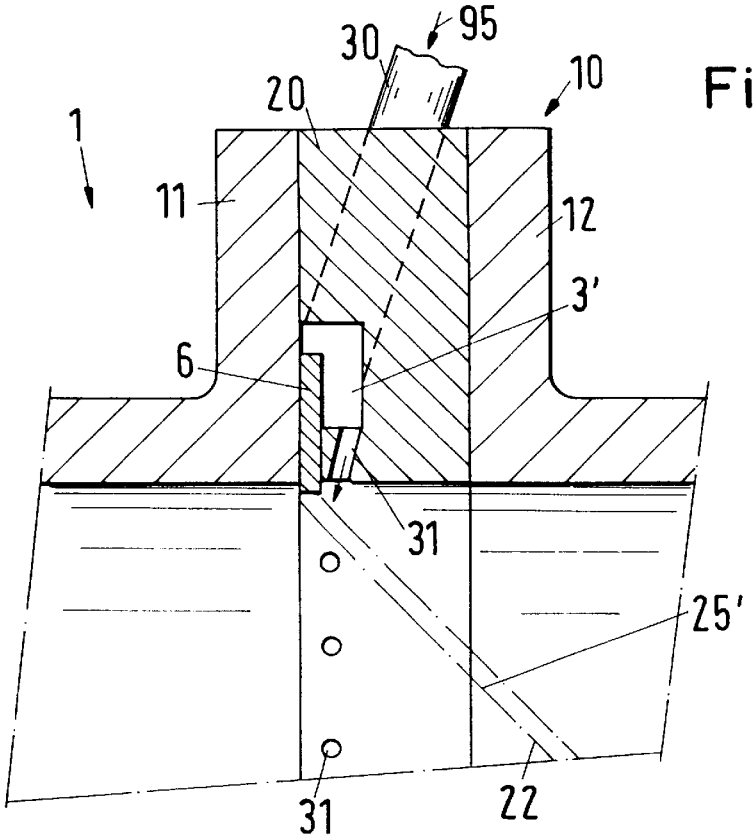
Fig.9
Fig.10
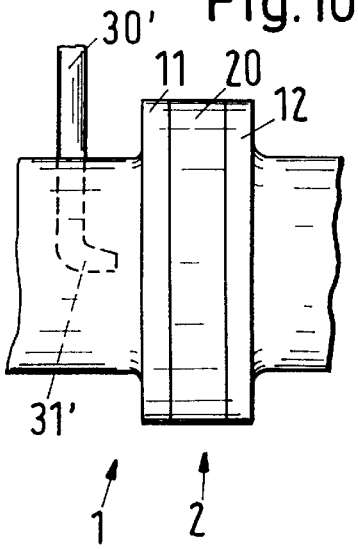
Fig.11
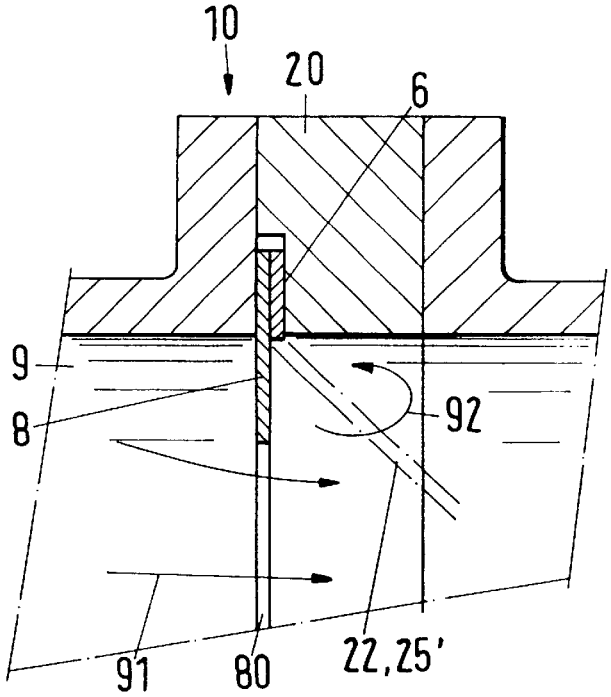

MIXING ELEMENT FOR A FLANGE TRANSITION IN A PIPELINE

BACKGROUND OF THE INVENTION

The invention relates to a static mixing element for a flange transition in a pipeline and to a pipeline having a mixing element of this kind.

Static mixers are known which are arranged in a pipe section of a pipeline. For the installation of a pipe section of this kind into the pipeline two flange pairs must as a rule be present: two flanges at the pipe section and two associated flanges at the pipeline. Static mixers of this kind cause small pressure losses if they do not greatly narrow the cross-section of the pipe section—which is as a rule the case—and thus cause only to a small extent a shedding of vortices which has a high dissipation of the flow energy as a result.

A flange mixer, for the installation of which only one flange pair is required, is known from U.S. Pat. No. 5,839,828. This flange mixer is formed in a stop-like manner. Its mixing-active structure comprises two mirror symmetric surface regions, between which a flow-through opening is located; the latter has a central narrows and two lens-like zones which extend transversely to the narrows. The surface regions can lie on two planes which are inclined with respect to one another and of which the crossing line—when projected perpendicularly onto a pipe cross-section—forms a centerline of the narrows. In a fluid which flows through the central narrows there arise vortices as a result of the stop action of the narrows which on the one hand have a mixing effect on admixed additives and on the other hand cause a relatively large pressure drop. As a result of the mirror symmetry a low material exchange takes place between the pipe halves which are given by the crossing line and the centerline.

Flange mixers have the advantage with respect to static mixers which are arranged in pipe sections that they have a small volume. In accordance with certain computational regulations they are not considered as pressure containers due to their small volume and therefore do not require an elaborate testing procedure for an approval. A disadvantage is that the flange mixer consists only of one mixing element and that it thus has a limited mixing action.

SUMMARY OF THE INVENTION

It is an object of the invention to create an alternative to the known flange mixer which has an improved mixing action with low pressure loss. In the admixing of an additive using the mixing element in accordance with the invention the additive can be fed in via a large number of input locations, so that the mixing action of the flange mixer which consists of only one mixing element can be sufficient.

The mixing element is provided for a flange transition in a pipeline and can be mounted between two flanges of the pipeline. It comprises a mixing-active structure which is formed by one or two vanes within a ring. Two mutually inclined planes can be defined, with the one vane being arranged on the one plane or with the two vanes being arranged on the two planes. The two planes intersect at a crossing axis. Closed sub-surfaces as well as open pieces of surface of the vanes form a surface pattern which is asymmetrically formed with respect to the crossing axis. Through the asymmetric shape a fluid which flows through the pipeline can be deflected in such a manner that partial flows are deflected from one pipe half through sub-surfaces of the one plane into the other pipe half and encounter there largely non-deflected partial flows, with this also holding vice versa with respect to the other plane if on the latter there is a second vane having structure elements.

In the following the invention will be explained with reference to the drawings.

BRIEF DESCRIPTION OF THE DRAWINGS

FIG. 9 is a part of a longitudinal section through an edge of a mixing element with infeed locations for an additive, FIG. 10 is a side view of a pipeline with an infeed location for an additive which is arranged upstream ahead of the mixing element, FIG. 11 is part of a longitudinal section through an edge of a mixing element with an additional stop.

DESCRIPTION OF THE PREFERRED EMBODIMENTS

Figure 1:
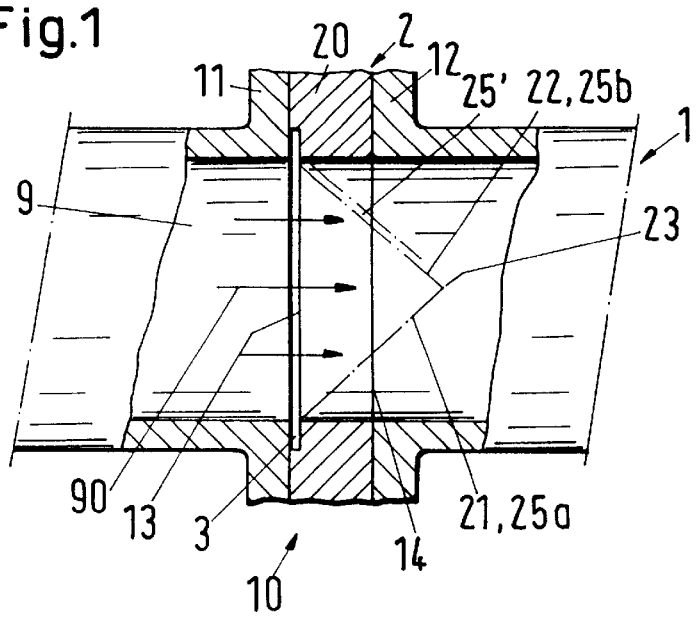
FIG. 1 is part of a longitudinal section through a pipeline at a flange location with an inserted ring.
Figure 2:
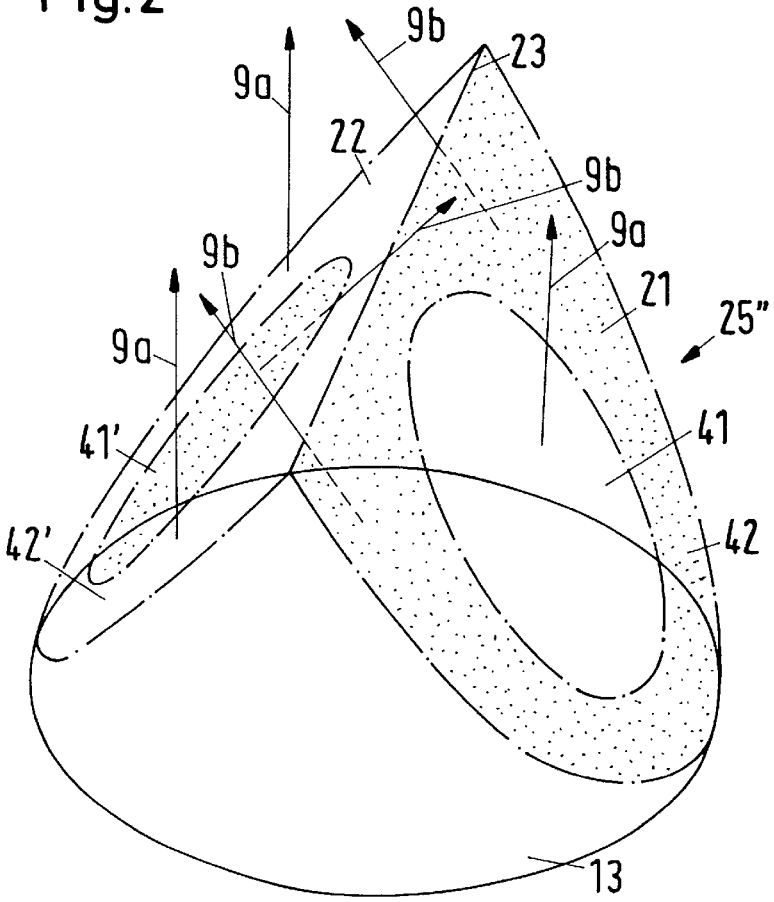
FIG. 2 is a schematic illustration pertaining to the flow behavior in a mixing element in accordance with the invention.

FIG. 1 shows a part of a longitudinal section through a pipeline 1 at the location of a flange transition 10 at which a ring 20 is inserted between flanges 11 and 12. In the inner region of the ring 20 there is arranged a structure 25, for which in the drawing only its location 25' is drawn in and which is illustrated in FIG. 2 in a schematic form 25" as a surface pattern. The structure 25 acts as a static mixer on a fluid 9 which is indicated by arrows 9 and which flows through the pipeline 1. The structure 25 can for example be manufactured of a sheet metal through punching and angling off. The mixing element 2, which is assembled from the ring 20 and the mixing-active structure 25, can be mounted at the flange transition 10; it is secured by means of non-illustrated screws of the flanges 11 and 12. The structure 25 is arranged with one vane 25*a* or 25*b* respectively each on two mutually inclined planes 21 and 22 respectively which intersect at a crossing axis 23. The crossing axis 23 is arranged downstream with respect to the ring 20. In a reversed arrangement of the mixing element 2 a mixing action also results, which is however not as good with respect to the pressure drop and mixing quality. The vanes 25*a* and 25*b* can be formed in such a manner that parts of them protrude beyond the crossing axis 23 onto the side of the other vane 25*b* or 25*a* respectively (cf. FIG. 12).

The use of a separate ring 20 is advantageous but not necessary. The mixing-active structure 25 can, if suitably formed, be clamped in between the flanges 11, 12.

Figure 3:
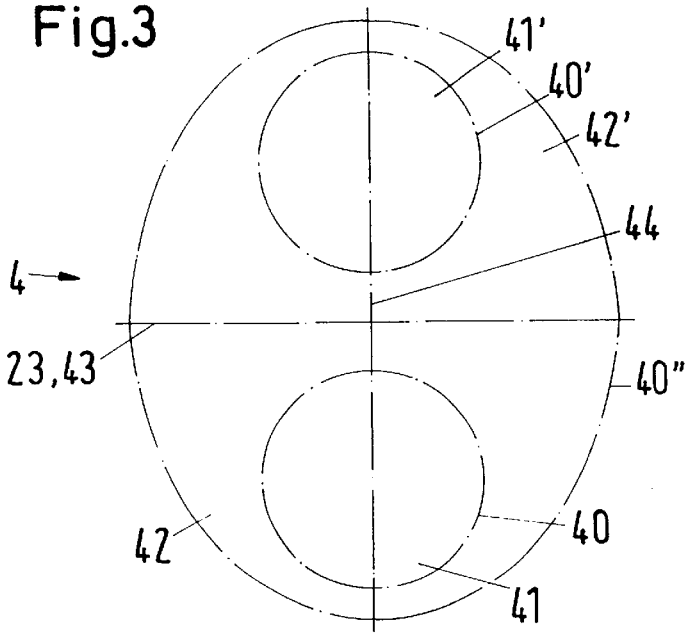
FIG. 3 is a reference system for a definition of the mixing-active structure of the mixing element in accordance with the invention.
Figure 4:
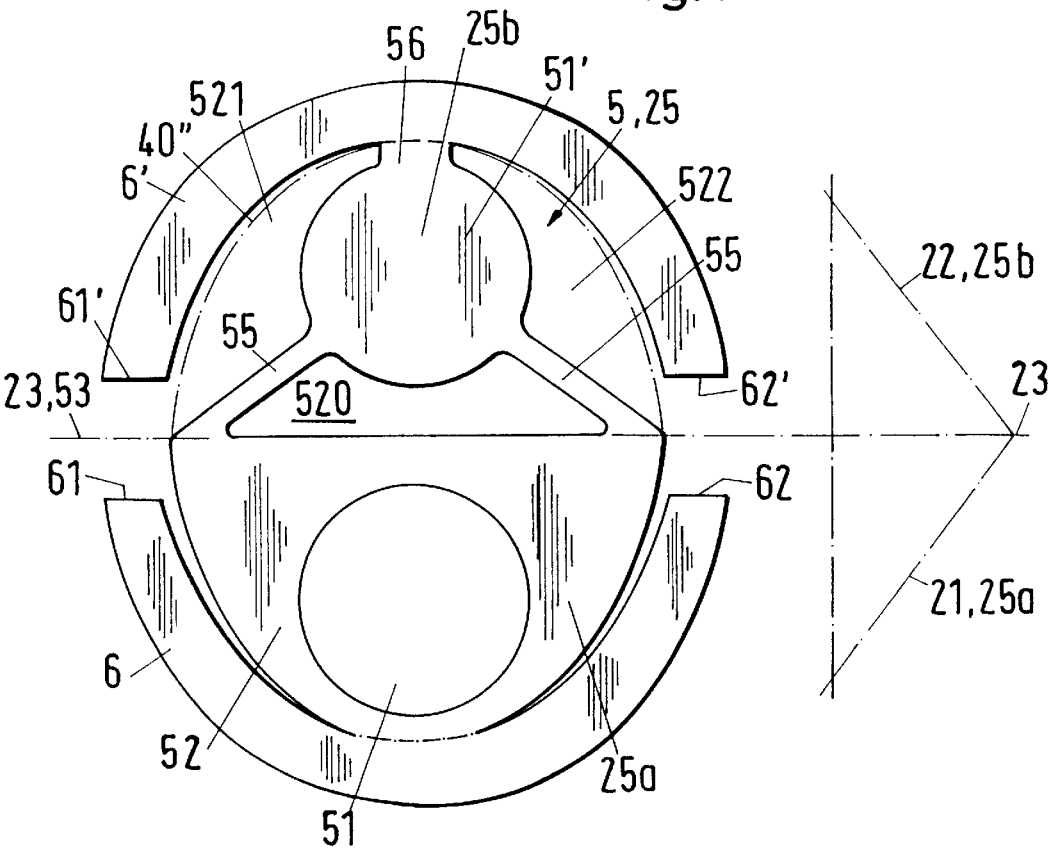
FIG. 4 is a surface pattern pertaining to the mixing element of FIG. 3 in accordance with a first exemplary embodiment.

Closed sub-surfaces and open pieces of surface of the structure 25 form a surface pattern 5, which is shown in a concrete embodiment in FIG. 4 with closed sub-surfaces 52, 51', 55, 56 and open pieces of surface 51, 520, 521, 522, with the surface pattern 5 being folded out into the plane of the drawing. In FIGS. 2 and 3 a surface pattern is illustrated which is introduced as reference system 4 for a characterization of the surface pattern 5. The reference system 4 in FIG. 3 is the planar unfolding of the surface pattern 25" which is shown in FIG. 2 in an oblique view.

The two vanes 25*a* and 25*b* largely have a complementary antisymmetrical shape in the following sense: (1) a reference system 4 can be defined which is formed by boundary lines 40, 40', 40", 43 of reference surfaces 41, 41', 42, 42' and which is mirror symmetric with respect to the crossing axis 23 or symmetry axis 43; (2) the sub-surfaces 52, 51', 55, 56 and pieces of surfaces 51, 520, 521, 522 of the surface pattern 5 and the reference surfaces 41, 41', 42, 42' of the reference system 4 cover over common regions 52, 51', 51, 520, 521, 522 which are smaller than or of equal size to that of the covering pieces of surfaces 41, 41', 42, 42'. These regions are closed partial surfaces 52, 51' or open partial surfaces 51, 520, 521, 522 in accordance with the surface pattern 5; and (3) the closed and open partial surfaces form with respect to the crossing axis 23 an asymmetrical arrangement, for which it holds that in the event of a mirroring at the crossing axis 23 or at the symmetry axis 43 the closed partial surfaces 52, 51' largely come to lie on open partial surfaces 51, 520, 521, 522 and that the reverse likewise holds. Through this antisymmetry an association between open and closed surfaces of the two vanes is given. Taken together the three open partial surfaces 520, 521, 522 which are arranged on the vane 25*b* are practically congruent (same shape and area) to the associated closed partial surface 52 of the other vane 25*a*. The open partial surface 51 of the vane 25*a* is congruent to the closed partial surface 51' of the other vane 25*b*.

Now the particular antisymmetry of the mixing-active structure 25 has the effect which is desired in accordance with the invention and which will be explained with reference to FIG. 2: The flow behavior of the fluid to be mixed is schematically indicated by the arrows 9*a* and 9*b*. In reality vortices also arise, which are essential for a good mixing action. These vortices are ignored in the present schematic illustration since another aspect of the mixing action is to be explained. The arrows 9*a* are oriented in the main flow direction (arrow 90 in FIG. 1). The arrows 9*b* indicate partial flows of the fluid which are deflected by the closed sub-surfaces of the structure 25. Thanks to the complementary antisymmetry the arrows 9*b* are in each case directed counter to an arrow 9*a*. These conditions are expressed in that a fluid exchange between the regions of the two vanes 25*a* and 25*b* takes place, so that a mixing through over the entire cross-section of the pipeline 1 results.

The mixing element 2 in accordance with the invention can be characterized more generally as follows: The surface pattern 5 of the mixing-active structure 25 is asymmetrically formed with respect to the crossing axis 23. Through the asymmetrical shape a fluid 9 which flows through the pipeline 1 can be deflected in such a manner that partial flows 9*b*, which are deflected by sub-surfaces of the one vane 25*a* to the side of the other vane 25*b*, encounter there largely non-deflected partial flows 9*a*. This also holds in reverse with respect to the deflected partial flows 9*b* of the other vane 25*b*.

The following is to be observed in regard to the structure 25 which is illustrated in FIG. 4: The structure 25 which is arranged in the interior of the pipeline 1 is connected to two ring pieces 6 and 6' which are laid in between the ring 20 and the flange 11—see FIG. 1. The structure 25 is angled off at the symmetry axis 53, so that the angle which is drawn in chain-dotted lines at the right in FIG. 4 arises. An angling off is also made between the ring pieces 6, 6' and the two vanes 25*a*, 25*b*, and indeed in such a manner that the ring pieces 6, 6' come to lie in the same plane. After the angling off the ring pieces 6 and 6' form joints at their ends 61 and 62 or 61' and 62' respectively.

Two further exemplary embodiments of the invention are illustrated in FIGS. 5 to 8. Whereas in the one example the number of open pieces of surface amounts to one on the one vane 25*a* and to two on the other vane 25*b*, in the other example this number is two and three respectively. In these examples the surface patterns 5 differ relatively strongly from the pattern of the reference system 4.

Figure 5:
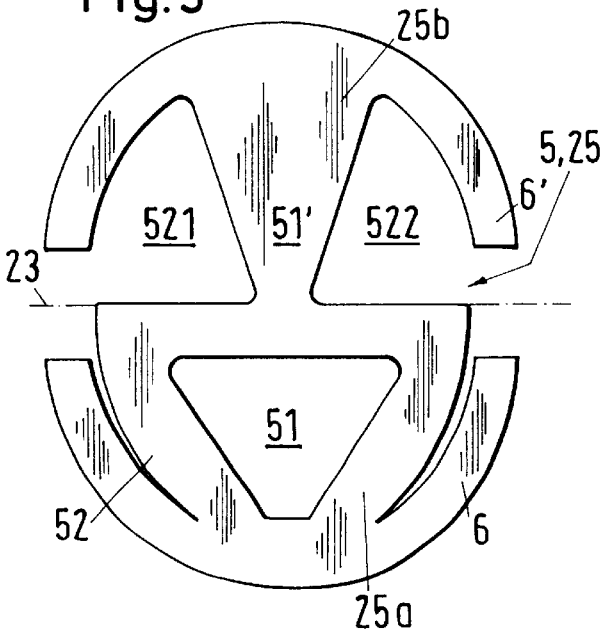
FIG. 5 is a surface pattern pertaining to a second exemplary embodiment.
Figure 6:
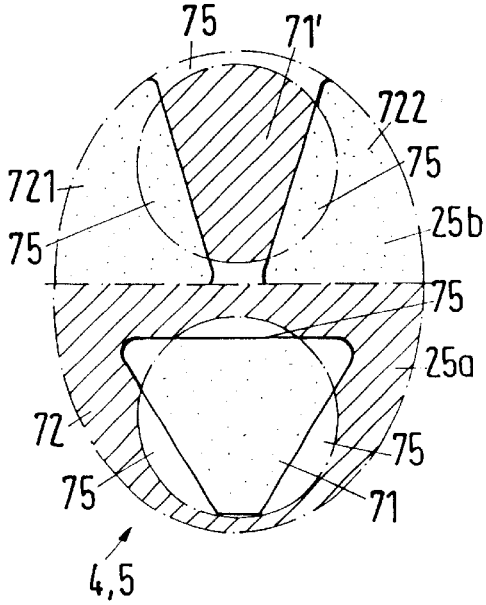
FIG. 6 is an auxiliary illustration for the definition of the mixing-active structure.

The same reference system as in the first example of FIG. 3 can be associated with the surface pattern 5 in accordance with FIG. 5 (with corresponding surfaces 51, 52, 521, 522 and 51' as in the first example, FIG. 4). FIG. 6 shows a superposition of the surface pattern 5 and the reference system 4. Common regions of this superposition, which are at most 30% smaller than the covering pieces of surface 51, 521, 522 or the sub-surfaces 51', 52 respectively of the surface pattern 5, are the closed partial surface 72 and the open partial surface 71 on the vane 25*a* and the closed partial surfaces 71' as well as the open partial surfaces 721, 722 on the vane 25*a*. With respect to these partial surfaces there is a complementary antisymmetry in agreement with the definition of the surface pattern 5, which the structure 25 has in accordance with the invention. In this definition the small sub-surfaces 75 which are left white in FIG. 6 are ignored.

Figure 7:
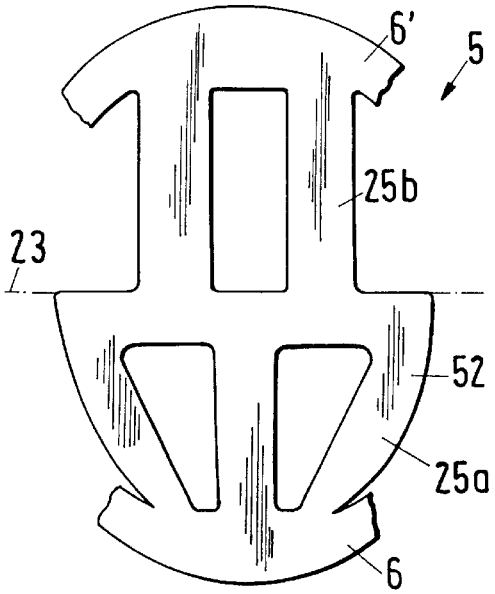
FIG. 7 is a surface pattern pertaining to a third exemplary embodiment.
Figure 8:
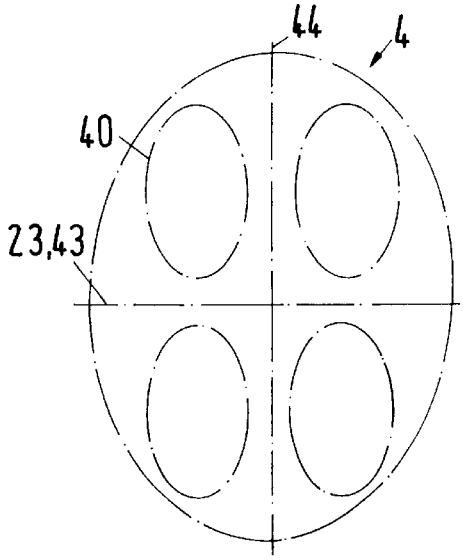
FIG. 8 is a reference system which can be associated with the surface pattern of FIG. 7.

The other mixing-active structure 5 with the somewhat more complicated surface pattern 5 is illustrated in FIG. 7. In this exemplary embodiment a correspondingly complicated reference system 4, namely that of FIG. 8, must be used as the basis. A superposition of the pattern 5 of FIG. 7 with the reference system of FIG. 8 leads—analogously to the superposition in FIG. 6—to common regions, for which again a complementary asymmetry exists. An explicit carrying out of this superposition will be dispensed with.

The mixing element 2 in accordance with the invention is supposed to lead to a mixing result which is connected with as small a pressure loss as possible. Therefore the open pieces of surface of the vanes 25*a* and 25*b* should as a whole not be substantially smaller than the free cross-section of the pipeline 1. This condition is fulfilled when the named open pieces of surface have on the whole at least the same area as the closed sub-surfaces and when the inclination of the planes 21 and 22 is relatively large, so that the angle which is enclosed by them at the crossing axis 23 is 120° or less.

If suitably formed the flange mixer 2 can be installed in and removed from the pipeline 1 without a removal of a part of the pipeline 1 being necessary. For this it is necessary that the vanes 25*a* and 25*b* be arranged largely in the region between the two end cross-sections 13, 14 of the ring 20 (see FIG. 1). For the surface pattern 5 of the mixing-active structure 25 a mirror symmetry with respect to an axis 44 (see FIGS. 3 or 8) which is perpendicular to the crossing axis 23 can be provided.

The mixing element 2 in accordance with the invention is well suited for feeding in an additive into the pipeline 1 at the flange location 10. In FIG. 9 infeed locations for an additive 95 which are integrated into the ring 20 are illustrated. They are formed by a plurality of or by a large number of uniformly arranged and equally large outlet openings 31. The additive 95 is conveyed via an inlet tube 30 into a ring groove 3', from which it enters via the outlet openings 31 into the acting region of the mixer structure 25 which is indicated by the chain-dotted lines 25'. Obviously inlet tubes 30 can also be provided for a plurality of additives or for other fluids to be admixed. A ring gap or radially inwardly leading grooves which are milled into the ring pieces 6 and 6' into the ring 20, or into an inserted seal (not illustrated), can also take the place of the many outlet openings 31.

Infeed locations 30' for fluid to be admixed can also be arranged upstream ahead of the mixing element, as is illustrated in FIG. 10. A fluid is fed in ahead of the mixing element 2 via a nozzle 31'.

In order to increase the vortice in the fluid flow of the pipeline 1 in the region of the flange mixer 2, additional vortices 92 can—see FIG. 11—be produced in the flow 91 behind the stop opening 80 with a stop 8 which is laid in at the flange position 10 together with the mixer structure 25. The stop 8 can also be part of the mixing-active structure 25; the structure 25 can be formed at the periphery in such a manner that it acts as a ring stop.

Figure 12:
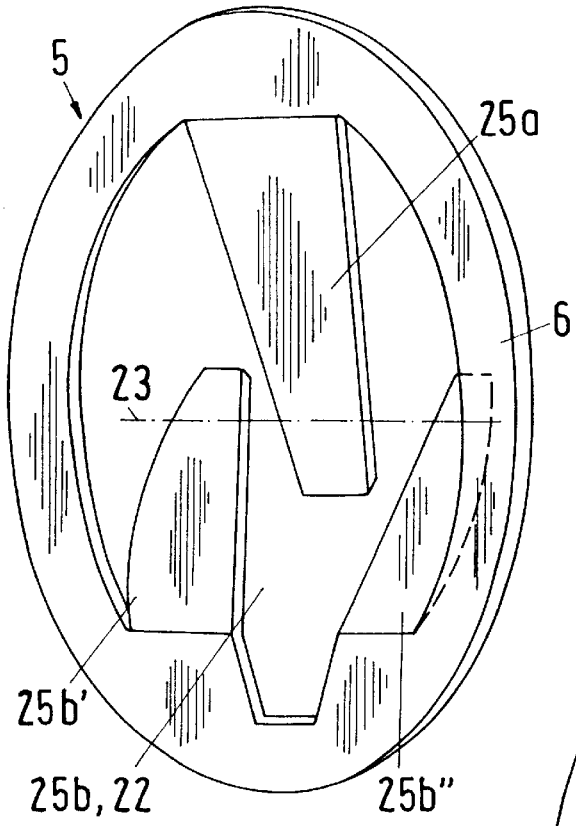
FIG. 12 is a further mixing-active structure.
Figure 13:
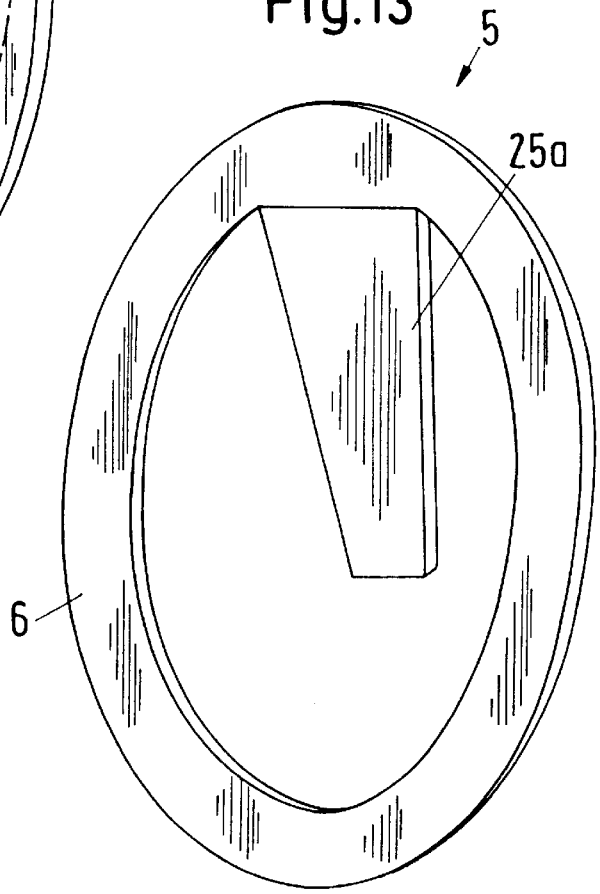
FIG. 13 is a modification of the structure of FIG. 12 with only one vane.

FIG. 12 shows a further mixing-active structure 25. The latter consists of a closed ring 6 which can be laid in between the pipe flanges 11, 12 (FIG. 1), a first vane 25*a* which is formed of a middle web, and a second vane 25*b* which is assembled from two lateral webs 25*b*' and 25*b*". The vanes 25*a* and 25*b* are formed in such a manner that parts of them protrude beyond the crossing axis 23 onto the side of the other vane 25*b* or 25*a* respectively. The middle web or the two lateral webs can be absent, so that the mixing-active structure 25 has only one vane 25*a*. A mixing element 2 which has a reduced structure 25 of this kind is likewise a mixing element in accordance with the invention. An example of a structure 25 of this kind which has only one vane is illustrated in FIG. 13; in comparison with the embodiment of FIG. 12 the vane with the lateral webs 25*b*' and 25*b*"0 is absent.

The mixing-active structure 25 can be manufactured of flexible material, for example of thin spring sheet metal or plastic. With different throughput the webs thus bend out differently; the flow resistance thus increases less rapidly with increasing throughput than if the webs were rigid.

The above-described mixing elements can be modified in such a manner that parts of one or both vanes 25*a*, 25*b* of the mixing-active structure 25 are bent out from the plane 21, 22 which is associated with the vane. Thus in the example of FIG. 12 the two lateral webs 25*b*' and 25*b*" can be bent out from the plane 22 by different angles.

What is claimed is:

1. A mixing element for fluid flow (2) flowing in a pipeline (1) between two flanges (11, 12) having placement at a flange transition (10) in the pipeline sidewalls across the pipeline comprising:

a static mixing structure for mounting to the flange transition (10);

a mixer structure supported from flange transition having two mutually inclined planes (21, 22), the two mutually inclined planes sloping from the pipeline sidewalls at their respective edges in the direction of fluid flow to a point of intersection and termination at a crossing axis (23) downstream of respective edges in the direction of fluid flow, the two mutually inclined planes each forming closed sub-surfaces (52, 51') for the deflection of fluid flow (9*b*) and defining openings in the sub-surfaces for the non deflection of fluid flow (9*a*);

a groove defined at the flange transition (10);

at least one ring piece (6, 6') attached to the mixer structure and dimensioned to be received in the groove defined at the flange transition to hold the static mixing structure relative to the pipeline (1);

a symmetrical mixing pattern coextensive with each inclined plane with the substantially the same symmetrical mixing pattern superimposed on each inclined plane, the symmetrical mixing pattern having mixing pattern boundaries between first pattern area(s) and second pattern area(s) on each inclined plane;

one inclined plane defining solid deflecting area(s) on the first pattern area(s) for the deflection of fluid flow (9*b*) and non-deflecting opening(s) on the second pattern area(s) for the non-deflection of fluid flow (9*a*); and, the other inclined plane defining non-deflecting opening (s) on the first pattern area(s) for the non-deflection of fluid flow (9*a*) and solid deflecting area(s) on the second pattern area(s) for the deflection of fluid flow (9*b*);

whereby when fluid passes the inclined planes, one inclined plane deflects volumes of flowing fluid (9*b*) at solid deflecting areas towards the other inclined plane non-deflected volumes of flowing fluid (9*a*) to produce contributory deflection and non-deflection volumes of fluid flow after the mixer structure to induce mixing of the fluid flow.

2. The mixing element according to claim 1 and wherein:

the symmetrical mixing pattern coextensive with each inclined plane is mirror symmetric th respect to the crossing axis (23).

3. The mixing element according to claim 1 and wherein:

images of the symmetrical mixing pattern having solid deflecting surfaces on one inclined plane cover non-deflecting openings on the other inclined plane when images of the symmetrical mixing pattern on each inclined plane are superimposed.

4. The mixing element according to claim 1 and wherein:

the solid deflecting areas and the non-deflecting openings have approximately same ureas.

5. The mixing element according to claim 1 and wherein:

the crossing axis 23 is downstream with respect to the flange transition (10) in the direction of fluid flow.

6. The mixing element according to claim 1 and wherein:

the two flanges (11, 12) have a separate ring (20) enclosing a volume between the flanges; and, the two mutually inclined planes (21, 22) are arranged in the volume enclosed by the separate ring (20).

7. The mixing element according to claim 1 wherein:

the symmetrical mixing pattern coextensive with each inclined plane is mirror symmetric with respect to an axis (44) which crosses the crossing axis (23).

8. The mixing element according to claim 1 and including:

a ring (20) for mounting to the flange transition (10) defining the groove at the flange transition; and, at least one ring piece (6, 6') dimensioned to be received in the groove defined at the ring (20) to hold the static mixing structure relative to the pipeline (1).

9. The mixing element according to claim 8 and further comprising:

infeed locations (30) integrally formed to the ring to permit additive flow (95) into the fluid flow (2) in the pipeline (1).

10. The mixing element according to claim 1 and further comprising:

a ring stop (8) protruding from the at least one ring piece (6,6') into the fluid flow (2) in the pipeline (1).

11. The mixing element according to claim 1 and wherein:

a part of the solid deflecting areas is actively bent outside of the plane of the two mutually inclined planes (21, 22).

12. The mixing element according to claim 1 and further comprising:

an infeed location (30) upstream of the static mixing structure.

* * * * *